US005143291A

United States Patent [19]

Grinsteiner

[11] Patent Number: 5,143,291

[45] Date of Patent: Sep. 1, 1992

[54] TWO-STAGE HYDRAULIC ELECTRICALLY-CONTROLLED UNIT INJECTOR

[75] Inventor: James J. Grinsteiner, Roselle, Ill.

[73] Assignee: Navistar International Transportation Corp., Chicago, Ill.

[21] Appl. No.: 851,130

[22] Filed: Mar. 16, 1992

Related U.S. Application Data

[63] Continuation of Ser. No. 678,576, Mar. 20, 1992, abandoned.

[51] Int. Cl.[5] ..... F02M 47/00

[52] U.S. Cl. ..... 239/88; 239/585.1; 123/446

[58] Field of Search ..... 239/88, 89, 90, 91, 239/92, 93, 94, 95, 585; 123/446, 501, 502

[56] References Cited

U.S. PATENT DOCUMENTS

| | | | |
|---|---|---|---|
| Re. 33,270 | 7/1990 | Beck et al. | 123/501 |
| 3,802,626 | 4/1974 | Regneault et al. | 239/585 |
| 4,219,154 | 8/1980 | Luscomb | 239/91 |
| 4,279,385 | 7/1981 | Straubel et al. | 239/90 |
| 4,405,082 | 9/1983 | Walter et al. | 239/91 |
| 4,605,166 | 8/1986 | Kelly | 123/446 |
| 4,653,455 | 3/1987 | Eblen et al. | 123/506 |

OTHER PUBLICATIONS

Caterpillar Fuel Injector, WGX3451, Jun. 24, 1987.

*Primary Examiner*—Andres Kashnikow
*Assistant Examiner*—Christopher G. Trainor
*Attorney, Agent, or Firm*—Dennis K. Sullivan

[57] ABSTRACT

A two-stage, hydraulic, electronic unit fuel injector powered by lubricating oil from the engine crankcase includes a housing, a pilot valve disposed in the housing and connected to an electronically-controlled solenoid for movement with the armature thereof, a slidable poppet valve disposed in the housing beneath the pilot valve and controlled by the action of the pilot valve, and a fixed intensifier dump valve disposed within the poppet valve. An intensifier piston, controlled by the action of the poppet valve, is disposed within the housing below the intensifier dump valve which upon receiving high pressure fluid, in this case, lubricating oil, is forced downwardly to inject fuel received in the lower end of the injector from a common rail out of the injector tip under very high pressure.

Both the pilot valve and the poppet valve are provided with valving arrangements, in the form of valve seats, internal passages, and registering annular grooves to provide and relieve the pressure acting respectively on the poppet valve and on the intensifier piston at various times during the injection cycle. Prior to the start of injection, the pilot valve provides high pressure to the top of the poppet valve forcing the poppet against its seat, relieving the pressure on the intensifier piston by dumping the pressurized oil externally of the injector onto the top of the cylinder head. When the pilot valve moves to start injection, it closes the high pressure source and dumps the pressurized oil above the poppet externally so that differential pressure acting upwardly on the poppet valve opens the poppet and exposes the intensifier piston to the high pressure source, causing injection. At the end of injection, the pilot valve closes, forcing the poppet down against its seat and dumping the oil from the intensifier piston causing injection to end.

19 Claims, 4 Drawing Sheets

TWO-STAGE HYDRAULIC ELECTRICALLY-CONTROLLED UNIT INJECTOR

This is a continuation of application Ser. No. 07/678,576, filed Mar. 20, 1992 now abandoned.

BACKGROUND OF THE INVENTION

This invention relates generally to an engine fuel injectors and more particularly, to an electrically controlled, two-stage, lubricating-oil-operated unit injector particularly suited for use in a diesel engine.

THE PRIOR ART

Many types of fuel injection systems have been used in delivering at a precise moment a precise amount of atomized fuel under high pressure to a combustion chamber of a diesel engine. In addition to fuel injection pumps which distribute timed quantities of highly pressurized fuel through pipes to nozzles, there are unit injector systems wherein low pressure fuel is delivered to the unit injector, as by a common fuel rail, and an electrically-controlled unit injector operating under electronic control delivers a timed quantity of high pressure fuel to the cylinder. There are two types of unit injectors, mechanical and hydraulic. In a mechanical unit injector, the pumping force to produce a high fuel pressure, and sometimes the injection timing, is produced by a cam lobe disposed on the engine camshaft. Such an injector is shown in U.S. Pat. No. 4,653,455 to Eblen et al.

In a hydraulic unit injector, the pumping force is produced by a motive fluid from a high pressure hydraulic pump which may be either fuel or lubricating oil. Lubricating oil is used in the present invention since, if a motive fluid leak should develop in the system, the lubricating oil merely flows back into the crankcase oil pan without contaminating the oil therein, an important feature when the unit fuel injector in the cylinder head of the associated engine is inside the valve cover.

U.S. Pat. No. 4,219,154 to Luscomb illustrates a hydraulic unit fuel injector wherein relatively high pressure fuel (3000 psi) is input through a solenoid operated shuttle valve to an intensifier piston to cause fuel, under amplified pressure, within a metering chamber ultimately to be discharged into the combustion chamber.

SUMMARY OF THE INVENTION

Accordingly, it is a primary object of the invention described and claimed herein to provide an electrically-controlled, hydraulically-operated unit fuel injector wherein performance sensitivity to tolerances and to lubricating oil viscosity is reduced.

A further object of the present invention is to provide an electrically-controlled, hydraulically-operated unit fuel injector wherein cold weather starting performance is improved by reducing flow restrictions caused by high viscosity cold lubricating oil.

Another object of the present invention is to provide an electrically-controlled, hydraulically-operated unit fuel injector wherein the throughflow of oil through the injector is reduced, thus improving the mechanical efficiency of the engine.

A further object of the present invention is to provide an electrically-controlled, hydraulically-operated unit fuel injector wherein more precise control of the beginning and the end of fuel injection, thereby improving engine performance.

A more specific object of the present invention is to provide an electrically-controlled, hydraulically-operated unit fuel injector with a two-stage valving arrangement above the intensifier piston which includes a small pilot valve actuated by an electronically controlled solenoid and a lightweight poppet valve.

The above objects are specifically met in a two-stage, electrically-controlled, hydraulically-operated unit fuel injector including a housing, a pilot valve disposed in the housing and connected to an electronically-controlled solenoid for movement with the armature thereof, a slidable poppet valve disposed in the housing beneath the pilot valve and controlled by the action of the pilot valve, and a fixed intensifier dump valve disposed within the poppet valve. An intensifier piston, controlled by the action of the poppet valve, is disposed within the housing below the intensifier dump valve which upon receiving high pressure fluid, in this case, lubricating oil, is forced downwardly to inject fuel received in the lower end of the injector from a common rail out of the injector tip under very high pressure.

Both the pilot valve and the poppet valve are provided with valving arrangements, in the form of valve seats, internal passages, and registering annular grooves to provide and relieve the pressure acting respectively on the poppet valve and on the intensifier piston at various times during the injection cycle. Prior to the start of injection, the pilot valve provides high pressure to the top of the poppet valve forcing the poppet against its seat, relieving the pressure on the intensifier piston by dumping the pressurized oil externally of the injector onto the top of the cylinder head. When the pilot valve moves to start injection, it closes the high pressure source and dumps the pressurized oil above the poppet externally so that differential pressure acting upwardly on the poppet valve opens the poppet and exposes the intensifier piston to the high pressure source, causing injection. At the end of injection, the pilot valve closes, forcing the poppet down against its seat and dumping the oil from the intensifier piston causing injection to end.

The splitting of the functions of the single high pressure valve of the prior art into a pilot valve and a poppet valve results in a location of the poppet valve within the injector which makes efficient use of the pressurized oil by providing short passages and small volume requirements, which in turn improves cold weather performance by reducing flow restrictions with high viscosity oil. Additionally, the amount of high pressure oil flowing through the injector is substantially reduced by the two-stage valve arrangement which closes the dumping passages when the pressure passages are open, thereby reducing the parasitic load on the engine. A faster poppet motion, due to greater opening and closing forces against a light weight poppet, improves the beginning and end of injection, ultimately improving engine performance as well. Further, travel of the poppet valve within this injector is not limited by being connected to the solenoid, thereby providing design freedom to increase lift, reduce the size and weight, and reduce the sensitivity to cold weather and to manufacturing tolerances.

BRIEF DESCRIPTION OF THE DRAWINGS

Other objects and advantages of the invention will become more apparent upon perusal of the detailed description thereof and upon inspection of the drawings in which.

DESCRIPTION OF THE PREFERRED EMBODIMENT

Figure 1:
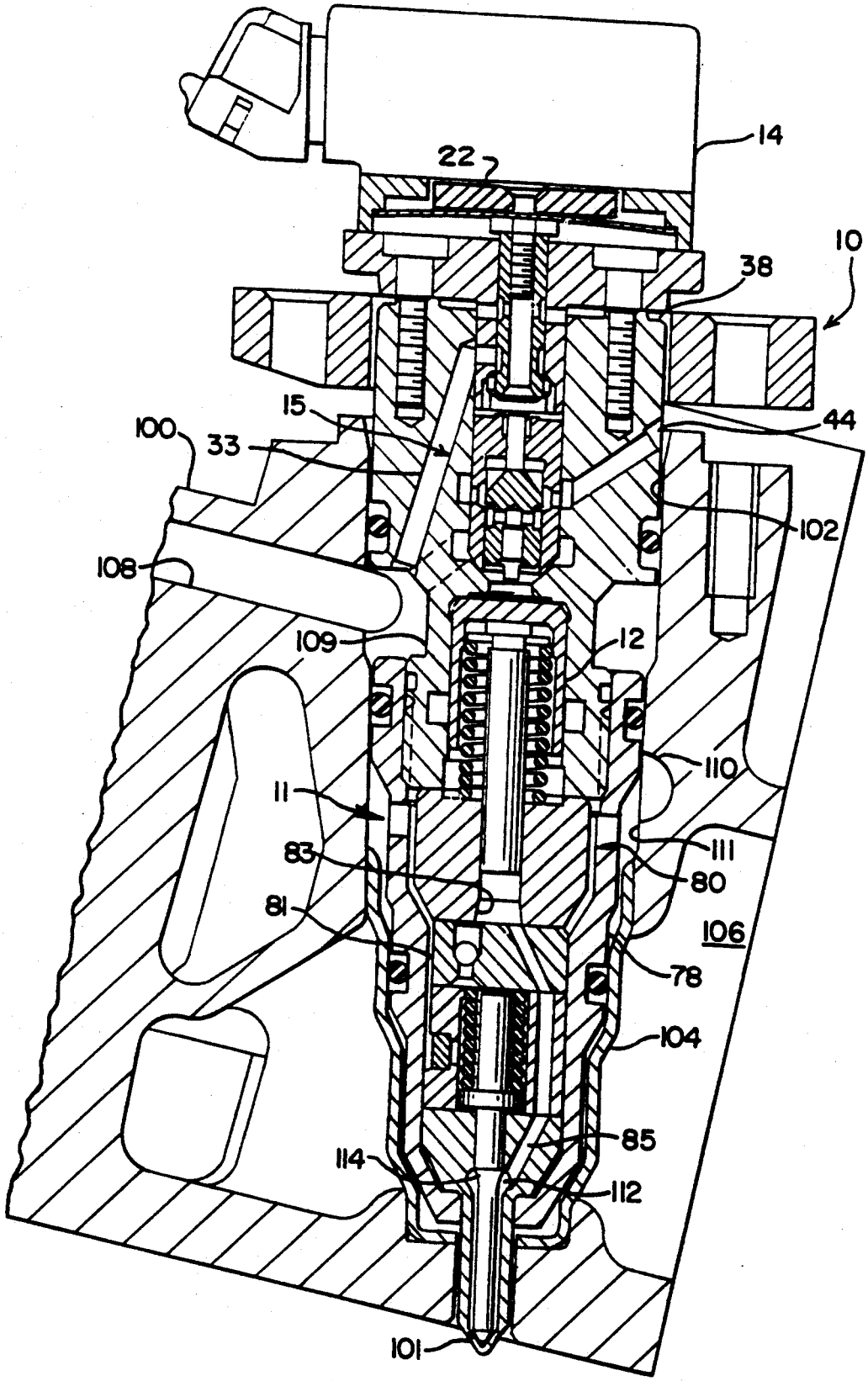
FIG. 1 is a vertical cross section through a hydraulic unit fuel injector of the present invention in its ambient environment in the cylinder head.

Referring now to the drawings in greater detail, there is illustrated in FIG. 1, the novel two-stage lubricating-oil-operated, electronically controlled unit fuel injector 10 of the present invention mounted in a cylindrical opening 102 therefore in cylinder head 100 of a diesel engine and extending through the lower face thereof to a tip 101 in an engine combustion chamber (not shown). As is conventional, the cylindrical opening 102 is provided with sleeve 104 mounted therein which receives the lower portion of the injector 10 while separating the injector and the upper portion of the opening 102 from the water jacket 106 within the head. The cylinder head 100 is further provided with a high pressure lubricating oil port 108 connected to a pump (not shown) operated by the engine which intersects a medial portion of the opening 102 at the exterior annulus 109 of the injector, the oil being provided at a pressure on the order of 3000 psi, and a relatively low pressure diesel fuel rail 110 which intersects the opening 102 below the lubricating oil port 108 at annulus 111 formed between the cylindrical opening 102 and the injector 10. The annuli 109, 111 respectively are sealed by O-rings as illustrated.

Figure 2:
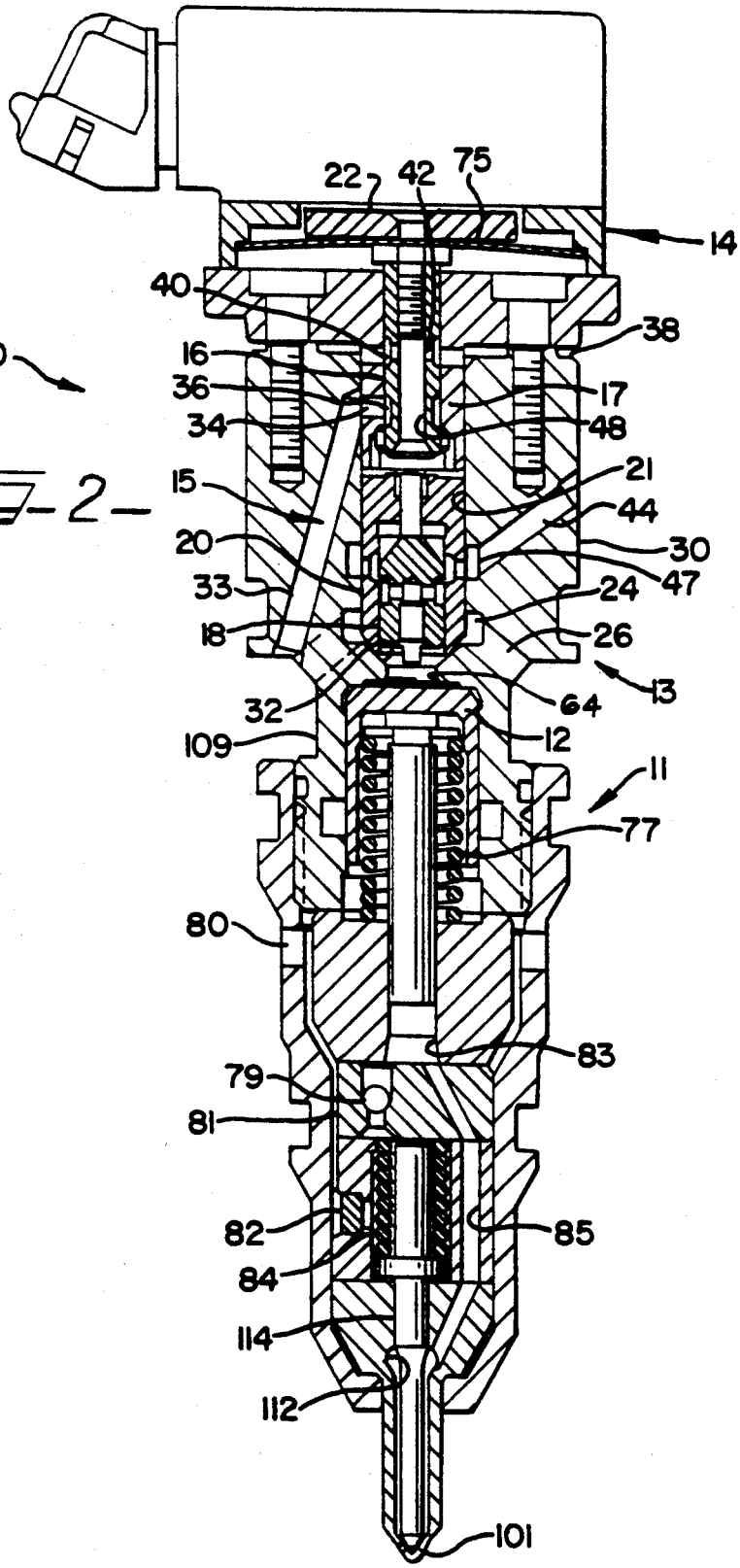
FIG. 2 is a vertical cross section through the hydraulic unit fuel injector of FIG. 1.
Figure 3:
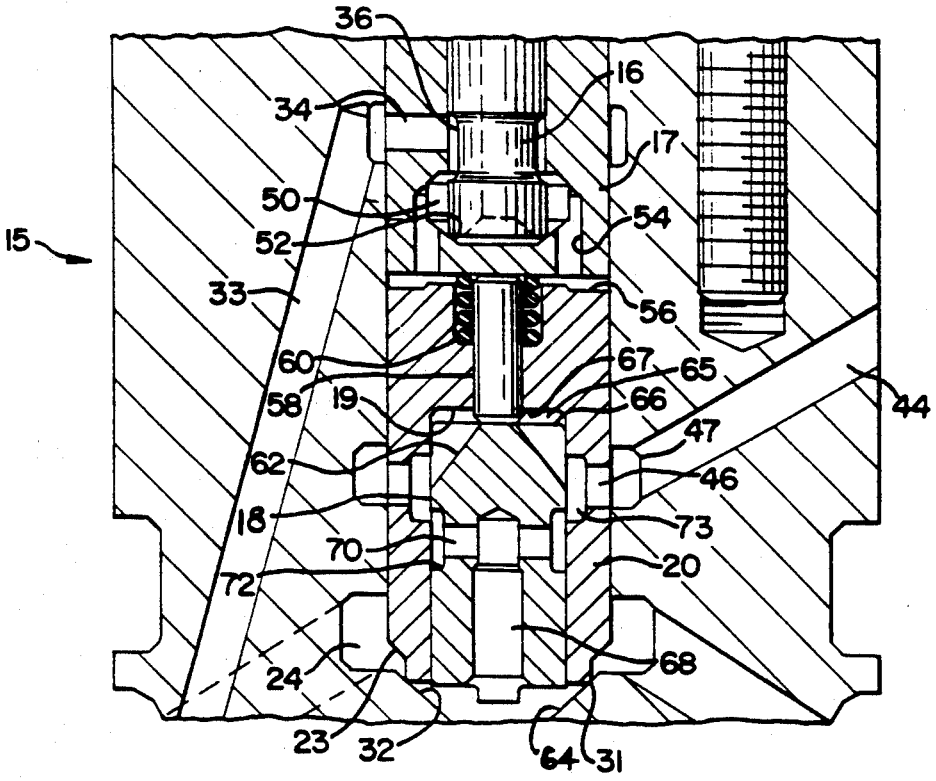
FIGS. 3–5 are enlarged vertical cross sections of the portion the injector between the intensifier piston and the solenoid of the unit injector showing the positions of the pilot valve and poppet valve respectively at the start of injection, during injection, and at the end of injection.

As illustrated in FIGS. 2 and 3, the injector 10 includes a lower portion generally 11 which includes an intensifier piston 12. Fuel from the fuel rail annulus 111 enters the injector 10 through ports 80 into an interior annulus shown exaggerated at 81 between the housing cap 78 and the components therewithin which extends down to a filter port 82. The fuel flows through the filter port 82 in to a chamber containing valve closing spring 84 and then upwardly through check valve 79 into the lower chamber 83 below the intensifier piston 12, which raises the pressure during injection, and then downwardly through an internal passage 85 to a lower valve chamber 112 within the nozzle tip 101 whereat, during injection, the valve 114 is opened by the upward pressure exerted on the enlarged upper portion of the valve 114.

In accordance with the invention, the upper portion 13 of the injector 10, including the area between the intensifier piston 12 and a solenoid 14 of the injector 10, is provided with a two-stage valve arrangement generally designated 15 including a pilot valve 16 attached to the armature 22 of solenoid 14 and situated within a pilot valve housing 17 fixed within a main central bore 21 of the injector housing 30, a poppet valve 20, and an intensifier dump valve 18 seated in fixed position within a central axial bore 19 of the poppet valve 20. The poppet valve 20 has a cylindrical outer periphery and is closely fit within in the main bore 21 of injector 10 beneath the pilot valve housing 17 and is axially slidable therein relative to the housing 30 and the dump valve 18. The diameter of the poppet valve is reduced near its lower end as at 23 (FIG. 3), to provide a surface against which pressure can act upwardly on the poppet valve for reasons to be discussed below, and terminates in an annular corner 31 which seats against a seating surface 32 in the injector housing 30.

The two-stage valve arrangement 15 utilizes engine lubricating oil to produce hydraulic pressure which acts upon the intensifier piston 12 in a timely, cyclic fashion to cause injection to occur, the cyclic operation of the injector 10 being controlled by the generation of an electric impulse by an electronic engine controller (not shown) to the solenoid 14 which acts to control the function of the two-stage valve arrangement 15 to achieve precise control of the intensifier piston 12 by raising the pilot valve 16, as will be described in greater detail hereinafter, to begin the injection process.

The lubricating oil entering the injector 10 from the high pressure lubricating oil annulus 109 in cylinder head 100 is communicated under constant pressure to an annulus 24 within injector 10 having a chamfered lower edge forming a valve seat 32 for the poppet valve 20 which separates the annulus 24 from the intensifier piston chamber 64 therebelow. It is against this constant oil pressure that the two valve arrangement 15 operates to cause injection. In order to provide oil under pressure into the interior of the injector 10, passages for supplying and eliminating the oil must be provided.

A first supply passage 26 is seen to extend from the oil annulus 109 through an injector housing 30 and into fluid communication with the annulus 24 surrounding and forming part of valve seat 32. A second supply passage 33 also originates at oil annulus 109 but extends upwardly into communication with a radial passage 34 in the pilot valve housing 17. The passage 33 in the housing 30 feeds the oil into and around an annular groove 36 undercut in the body of the pilot valve 16.

To allow for return of the oil to the engine crankcase when it has completed a circuit through the injector 10, an outflow or dump passage must be provided for each of the valves 16, 18 and 20.

A first dump passage 38 is provided for eliminating oil from the area of the pilot valve 16. This passage 38 is seen to extend radially from a point of communication with an annulus 40 about the pilot valve 16 which communicates with a crossbore 42 within the pilot valve 16 which in turn communicates with a vertical throughbore 48 which opens to the lower end of the pilot valve. It will be seen, in FIGS. 3–5, that the lower part of pilot valve housing 17 is provided with an annular chamber 50 having an angled lower surface which forms a valve seat 52 for the lower periphery of pilot valve 16. The chamber 50 also communicates through axial passages 54 the area above an upper surface 56 of poppet valve 20. Thus, when the pilot valve is lifted from its seat 52, lubricating oil can be dumped from the chamber 50, and area 56, through the throughbore 48 in the pilot valve 16 and out through passages 42, 40, and 38 onto the upper surface of the cylinder head 100 and then through the usual drains back to the crankcase.

A second dump passage 44 is provided for carrying oil away from the intensifier dump valve 18 and poppet valve 20. This passage 44 extends angularly upwardly from a port 46 in the poppet valve 20, and out onto the surface of the cylinder head 100, as above. The port 46 is surrounded by an annulus 47 which is cut into the housing 30.

The intensifier dump valve 18 is maintained at a predetermined distance from pilot valve housing 17 by a locating pin 58. The locating pin 58 has a biasing spring 60 disposed around an upper end thereof between the pilot valve housing 17 and the poppet valve 20 to bias the poppet valve downwardly against its seat so that when no lubricating oil is flowing through the injector 10, as is the case when the engine is off, the poppet valve 20 will keep oil from draining from the high pressure annulus 24. This provides for easier engine starts in cold weather.

Turning now to the intensifier dump valve 18, the valve 18 will be seen in FIG. 3 to include an angled slot 62 therein which leads from an upper surface 66 thereof radially outwardly into communication with dump passage 46 at all times. This is a pressure relief passage 62 which eliminates any oil which may seep into and become trapped within a space 65 between the upper surface 66 of the intensifier dump valve 18 and the upper end wall 67 of the central axial bore 19 within poppet valve 20. If oil could not be relieved from this space 65, pressure buildup therein could inhibit movement of the poppet valve 20 and cause injector 10 to cease functioning.

Intensifier dump valve 18 also includes a central axial bore 68 in the lower portion thereof which is open to the intensifier piston chamber 64 at its lower end and terminates upwardly in a crossbore 70 feeding an undercut annular groove 72 provided around the periphery of intensifier dump valve 18. This annular groove 72 is in partial registry with dumping annulus 73 in the poppet valve 20 when the poppet valve is seated against seat 32.

Figure 4:
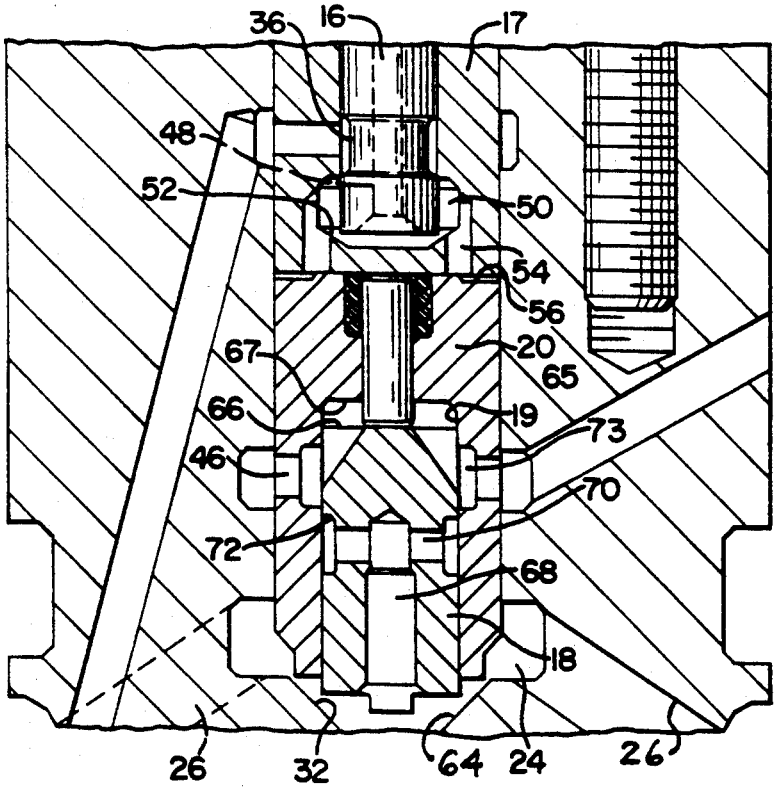
Figure 5:
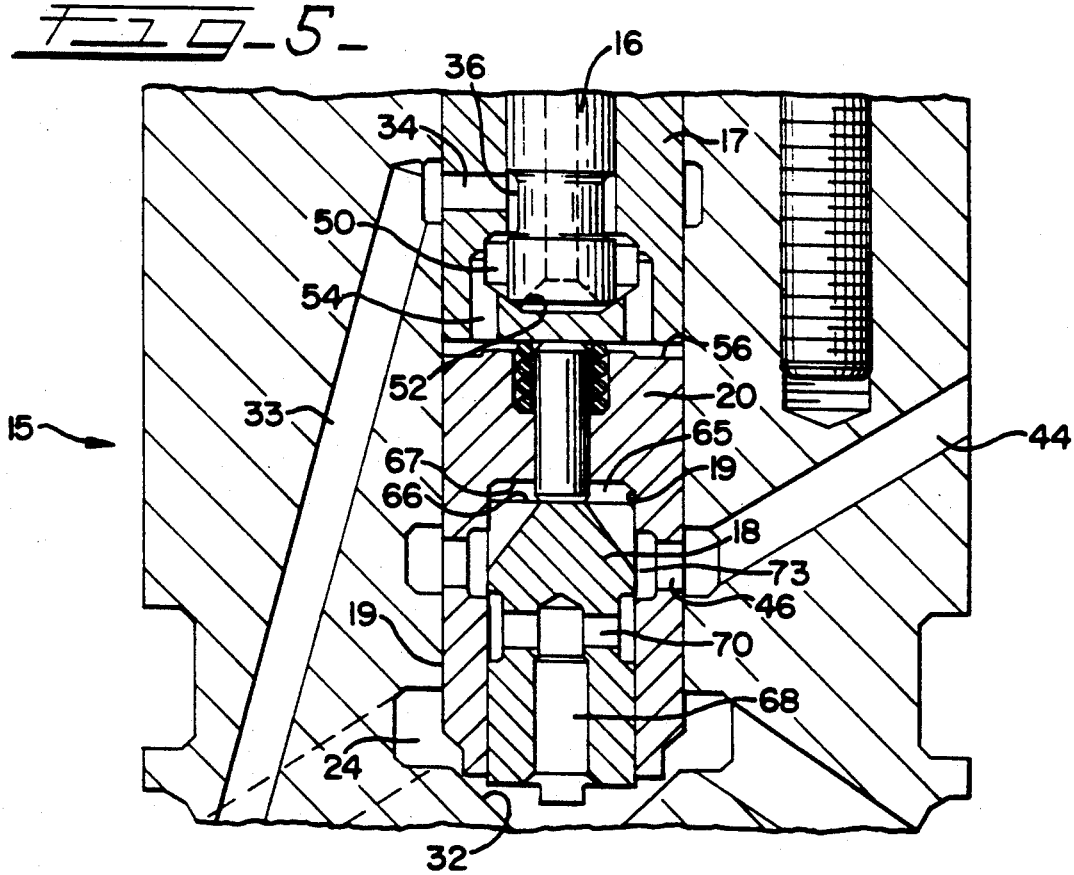

The uniqueness of the injector 10 can best be understood by a review of operation of the injector 10 during one injection cycle. Referring now particularly to FIGS. 3-5, there is illustrated therein the valve movements which take place during one complete injection cycle.

FIG. 3 illustrates the position of the pilot and poppet valves in the injector 10 at the beginning of an injection cycle. At the start of injection, the solenoid 14 is not energized, and the pilot valve 16, due to spring pressure applied thereagainst by a leaf spring 75 (FIG. 2) of the armature 22, is seated against valve seat 52. It will be seen that the high pressure oil passage 34 is in communication with the annular groove 36 around the pilot valve 16 and that the annular groove 36 is also in communication with the chamber 50 surrounding the lowermost portion of the pilot valve 16. With this alignment, oil under pressure flows through the axial passages 54 in the pilot valve housing 17 and communicates the pressure against the entire upper surface 56 of the poppet valve 20 seating the annular corner 31 thereof against valve seat 32, closing off the high pressure oil annulus 24 from the base of the poppet valve 20. There is some force acting upwardly against surface 23; however, it is overcome by the larger force exerted by the same pressure over the larger area at the top 56 of the poppet valve. Since the annulus 72 is in partial registry with dumping annulus 73 in the poppet valve 20 which communicates with the dump passage 44 in the injector housing 30, there is no pressure on the intensifier piston 12 so it is seated at its uppermost position under action of biasing spring 77.

When the solenoid 14 receives an electrical pulse, it pulls upwardly on armature spring 75 to which the pilot valve 16 is operatively engaged and raises the pilot valve 16 off valve seat 52 resulting in several simultaneous occurrences shown in FIG. 4. First, communication is sealed off between the chamber 50 in the pilot valve housing 17 and the annular groove 36 around the pilot valve 16 closing off the entry path for high pressure oil into the chamber 50 while permitting the pressurized oil in chamber 50, and the area above the top side 56 of the poppet, to enter the central throughbore 48 of the pilot valve 16 and be dumped from the injector 10 through passage 38. Since the area above the upper surface 56 of poppet valve 20 is no longer pressurized, the poppet valve rises, initially under the force provided against surface 23, until it abuts pilot valve housing 17. The annular corner 31 of the poppet valve 20 rises off the seat 32 and opens the high pressure oil annulus 24 to fill the area beneath poppet valve 20 and create a downward force against the intensifier piston 12, moving it downwardly.

Meanwhile, upon the poppet valve 20 moving upwardly, dumping annulus 73 thereon is moved out of registry with dumping annulus 72 of dump valve 18 closing the dump passage 46 so that pressure is maintained on the intensifier piston 12. As the intensifier piston 12 moves downwardly, its lower end creates pressure in the lower fuel chamber 83 on the order of 17,000 psi which closes the check valve 79 during injection and feeds the fuel, which has entered the lower chamber through the check valve 79 between injections, in the manner described above, through passage 85 down to the injection valve chamber 112 whereat the valve 114 is lifted by the pressure and fuel is ejected from the nozzle tip 101.

Once injection takes place, the solenoid 14 is de-energized and a reversal of the valve movements begins to take place. As illustrated in FIG. 5, leaf spring 75 of the armature 22 moves downwardly toward its pre-injection position, moving the pilot valve 16 attached thereto against its valve seat 52. This valve movement opens communication between annular groove 36 on pilot valve 16 and the chamber 50 while closing off the dumping passage through throughbore 38, pressurizing chamber 50 once again. As the pressure in the chamber 50 builds up, the poppet valve 20 begins to move downwardly to close off chamber 24 from the intensifier piston 12 while at the same time bringing the poppet dumping annulus 73 back into partial registry with dumping valve annulus 72 relieving the pressure between the dump valve 18 and the intensifier piston 12 so that the biasing spring 77 inside the intensifier piston 12 pushes the piston 12 upwardly, forcing the oil in the chamber 64 thereabove upwardly through the dump valve bore 68 and out through the dump passage 44. The upward travel of the intensifier piston 12 also quickly reduces the pressure in valve chamber 112 acting on the nozzle valve 114, closing it, and draws a fresh charge of fuel through the check valve 79 to refill the lower fuel chamber 83 to prepare for the next injection.

Although shown exaggerated in the drawings, the extent of movement of the pilot and poppet valves 16 and 20 within the injector is quite small. For example, the pilot valve 16 need only move about 1/100 of an inch during function of the injector 10 while the poppet valve may move twice as much or more. Moreover, due to the two-stage valve arrangement 15, the movement of the poppet valve 20 is not limited by the capacity of the solenoid 14 since the solenoid only actuates the pilot valve 16. Accordingly, the poppet valve 20 can be designed for increased lift, resulting in less sensitivity to manufacturing tolerances and also to oil viscosity in cold weather, improving engine starting. The increased poppet valve lift also permits a reduction of the diameter and weight of the valve to provide quicker valve movement, which results in a sharper beginning and cutoff of injection and reducing engine emissions. The quicker valve movement also results in a higher mean injection pressure and therefore a shorter injection duration for a given quantity of fuel, which improves combustion efficiency of the engine. Accordingly, the injector 10 is extremely energy efficient.

Further, whenever the poppet valve 20 is unseated, the dumping annuluses 72 and 73 are out of registry, eliminating throughflow of high pressure lubricating oil which wastes energy. The consequent reduction of the parasitic engine load from the high pressure oil pump results in increased engine mechanical efficiency and improved engine fuel economy.

As disclosed, the injector 10 has a number of advantages, some of which have been described above and others of which are inherent in the invention. Also modifications may be proposed to the injector 10 without departing from the teachings herein. Accordingly, the scope of the invention should only be limited as necessitated by the accompanying claims.

What is claimed is:

1. In a hydraulic, electrically-controlled, unit fuel injector for an engine including a selectively operable solenoid, a high pressure valve means operated by the solenoid, and an intensifier piston chamber, said injector being hydraulically actuated to inject fuel by high pressure fluid supplied from a source through said valve means to said intensifier piston chamber, the improvement wherein said valve means comprises:

pilot valve means operatively coupled to said solenoid for axial movement therewith between a closed position communicating said high pressure fluid from said source through said pilot valve means and then to a poppet valve chamber and an injection position relieving high pressure fluid from said poppet chamber; and poppet valve means disposed in said poppet valve chamber for axial movement therein under the influence of said pilot valve between a closed position preventing communication of said high pressure fluid to said intensifier piston chamber, said closed position existing when said pilot valve is communicating said high pressure fluid from said source through said pilot valve means and then to said poppet valve chamber, and an injection position providing communication of said high pressure fluid to said intensifier piston chamber, said injection position existing when said pilot valve prevents communication of said high pressure fluid from said source through said pilot valve means and then to said poppet valve chamber, said poppet valve means further including dumping means providing pressure relief of said intensifier piston chamber when said poppet valve is in said closed position.

2. The invention in accordance with claim 1 wherein said dumping means comprises an intensifier dump valve seated in fixed position within a central bore within said poppet valve means, said intensifier dump valve and said poppet valve means having selectively registrable passages responsive to movement of said poppet valve means defining a fluid path for relieving fluid pressure from said intensifier piston.

3. The invention in accordance with claim 2 wherein said pilot valve means includes passage means providing pressure relief from said poppet valve chamber upon said pilot valve means being in said injection position.

4. The invention in accordance with claim 3 and said high pressure fluid comprises engine lubricating oil provided from said source under constant pressure to a common annulus on the injector in fluid communication with both said pilot valve means and said poppet valve means.

5. The invention in accordance with claim 4 wherein said poppet valve means is exposed to said high pressure fluid at both ends thereof, said poppet valve means having a greater effective radial area on the end thereof exposed to said fluid in said poppet valve chamber than the effective radial area on the opposite end thereof.

6. In a hydraulic, electrically-controlled, unit fuel injector for an engine including a selectively operable solenoid, a high pressure valve means operated by the solenoid, and an intensifier piston chamber, said injector being hydraulically actuated to inject fuel by high pressure fluid supplied from a source through said valve means to said intensifier piston chamber, the improvement wherein said valve means comprises:

a pilot valve housing means having a pilot pressure chamber, a pilot inlet connected to said source of high pressure fluid, a pilot outlet connected to a low pressure reservoir, and a pilot valve seat disposed between said pilot pressure chamber and said pilot outlet;

a pilot valve disposed within said pilot valve housing, said pilot valve being operatively coupled to said solenoid for axial movement therewith between a closed position seated against said pilot valve seat, said pilot inlet being connected to said pilot pressure chamber, and an injection position displaced from said pilot valve seat, said pilot pressure chamber being operatively connected to said pilot outlet and said pilot inlet being operatively disconnected from said pilot pressure chamber;

a poppet valve housing means having a first poppet inlet connected to said source of high pressure fluid, a second poppet inlet connected to said pilot valve pressure chamber, a poppet outlet, and a poppet valve seat disposed between said first poppet inlet and said poppet outlet, said intensifier piston chamber being in selective fluid communication with said poppet outlet;

a poppet valve slidably disposed for axial movement within said poppet valve housing means between said first poppet inlet and said second poppet inlet, said poppet valve being operated by said pilot valve to control high pressure fluid flow to the intensifier piston chamber in such a manner that, upon energization of the solenoid, the pilot valve is disposed in a position relieving the pressure at said second poppet valve housing inlet and causing the poppet valve to assume a position connecting said first housing inlet with said intensifier piston chamber, thereby causing injection from said injector, and upon said solenoid being deenergized, said pilot valve is in a position establishing communication of said second poppet valve housing inlet to said source of high pressure fluid and causing said poppet valve to assume a position closing said first poppet valve housing inlet from said intensifier piston chamber while opening a fluid path for relieving fluid pressure from said intensifier piston chamber, thereby ending injection from said injector.

7. The invention in accordance with claim 6 wherein said high pressure fluid comprises engine lubricating oil provided from said source under constant pressure to a common annulus on the injector in fluid communication with both said pilot inlet and said poppet valve housing first inlet.

8. The invention in accordance with claim 6 wherein said pilot valve is normally held in said closed position by a spring, said solenoid overcoming said spring upon actuatation thereof to open said pilot valve.

9. The invention in accordance with claim 6 and said poppet valve having a greater radial area exposed to said second poppet inlet than the area exposed to said first poppet inlet, said poppet valve being moved to said closed position thereof when said high pressure fluid, under control of the pilot valve, is exposed to the greater radial area of the poppet valve to cause a downward motion of said poppet valve.

10. The invention in accordance with claim 9 wherein said poppet valve includes a stepped outer periphery defining said area exposed to said first inlet, said area being sufficiently large that, upon said pressure at said second poppet inlet being relieved, said poppet valve is moved by said pressure at said first inlet to raise said poppet valve to said open position.

11. The invention in accordance with claim 10 and a compression spring disposed between said poppet valve and said pilot valve housing, said spring maintaining said poppet valve in a closed position in the absence of pressure at said first poppet inlet.

12. The invention in accordance with claim 11 including an intensifier dump valve seated within a central bore within said poppet valve, said intensifier dump valve defining said fluid path for relieving fluid pressure from said intensifier piston.

13. The invention in accordance with claim 12 wherein an upper surface of said intensifier dump valve is maintained in a predetermined fixed position from a lower surface of said pilot valve housing by a locating pin relatively slidably extending through an upper wall of said poppet valve.

14. The invention in accordance with claim 12 wherein the outer periphery of said intensifier dump valve includes an annular groove in fluid communication with said intensifier piston and said poppet valve includes radial passage means which, upon said poppet valve being in said closed position, partially registers with said annular groove and establishes fluid communication therethrough with an oil dump passage in said injector, and upon said poppet valve being in said open position, is out of registry with said annular groove.

15. The invention in accordance with claim 14 wherein the intensifier dump valve further includes a pressure relief passage establishing fluid communication between an upper surface thereof and said radial passage in said poppet valve, said pressure relief passage being closed off from said annular groove when said poppet valve is in said open position.

16. The invention in accordance with claim 6 wherein said pilot valve includes an axial throughbore therein opening to said pilot pressure chamber upon said pilot valve being raised from said pilot valve seat, said throughbore communicating with a radial passage in said pilot valve in turn communicating with said pilot outlet.

17. The invention in accordance with claim 6 wherein the outer periphery of said pilot valve includes an annular groove disposed thereon to permit communication between said pilot housing inlet and said pilot pressure chamber when said pilot valve is against said valve seat and, upon said pilot valve being raised from said pilot valve seat, to prevent communication therebetween.

18. The invention in accordance with claim 6 wherein the pilot valve travels a distance approximately 1/100 of an inch.

19. The invention in accordance with claim 6 wherein the range of motion of said poppet valve is at least twice that of said pilot valve.

* * * * *